US009095015B2

(12) United States Patent
Welten

(10) Patent No.: US 9,095,015 B2
(45) Date of Patent: Jul. 28, 2015

(54) CONFIGURABLE LIGHT FIXTURE, CONFIGURABLE LIGHTING SYSTEM AND METHOD FOR CONFIGURING A LIGHTING SYSTEM

(75) Inventor: Petrus Johannes Maria Welten, Oss (NL)

(73) Assignee: ELDOLAB HOLDING B.V., Son en Breugel (NL)

( * ) Notice: Subject to any disclaimer, the term of this patent is extended or adjusted under 35 U.S.C. 154(b) by 614 days.

(21) Appl. No.: 13/059,577

(22) PCT Filed: Aug. 18, 2009

(86) PCT No.: PCT/NL2009/000161

§ 371 (c)(1), (2), (4) Date: Feb. 17, 2011

(87) PCT Pub. No.: WO2010/021542

PCT Pub. Date: Feb. 25, 2010

(65) Prior Publication Data

US 2011/0148685 A1 Jun. 23, 2011

Related U.S. Application Data

(60) Provisional application No. 61/089,996, filed on Aug. 19, 2008.

(51) Int. Cl.

| | |
|---|---|
| ***G08C 19/12*** | (2006.01) |
| ***G08C 19/16*** | (2006.01) |
| ***G08B 1/00*** | (2006.01) |
| ***H05B 37/02*** | (2006.01) |

(Continued)

(52) U.S. Cl.

CPC ..... *H05B 37/0272* (2013.01); *G08C 19/28* (2013.01); *H05B 37/0281* (2013.01); *G07C 2009/00238* (2013.01); *G08C 2201/20* (2013.01)

(58) Field of Classification Search

CPC ..... G08C 19/00; G08C 2200/00; G08C 2201/12; G08C 2201/40; G08C 19/28; H05B 31/0003; H05B 33/00; H05B 41/00; H05B 37/00; H05B 31/006; H05B 31/0072; H05B 31/0081; H05B 35/00; H05B 37/0209; H05B 33/10; H05B 39/041; H05B 39/105; H05B 41/14; H05B 41/38; H05B 37/0272; H05B 41/245; H05B 41/382; H05B 31/0075; H05B 31/18; H05B 31/30; H05B 37/032; H05B 31/00; H05B 31/0048; H05B 31/10; H05B 31/0057; H05B 39/00; H05B 39/04; H05B 39/10; H05B 37/036; H05B 33/06; H05B 39/0041; H05B 31/36; H05B 37/0281; H05B 33/0842; H05B 33/0854; H05B 37/029; H05B 37/03; H05B 37/0227; H05B 37/02; F25B 2600/00; F25B 2700/00; H02H 5/00; H02J 11/00; H02J 2001/00; G05B 2219/00; G05B 2219/13004; G07C 2009/00238; G07C 2009/00793; G07C 9/00182; G09G 3/2014; H04L 12/66; Y02B 20/42

USPC ..... 340/12.23–12.3, 12.32–12.39, 340/12.5–12.51, 13.2, 13.23, 13.24–13.3, 340/14.3–14.31, 5.23, 5.64, 5.71, 5.2, 340/426.13, 12.29, 309.16, 13.28, 870.03, 340/7.25, 5.1, 533, 534; 701/36, 49; 341/176; 343/895, 853; 315/155, 380, 315/134, 312, 149, 154, 317, 323; 250/205, 250/348

See application file for complete search history.

(56) References Cited

U.S. PATENT DOCUMENTS 4,750,118 A * 6/1988 Heitschel et al. ..... 700/90
5,926,115 A 7/1999 Schleder et al.

(Continued)

FOREIGN PATENT DOCUMENTS

WO WO 03077610 A1 9/2003

*Primary Examiner* — Mirza Alam

(74) *Attorney, Agent, or Firm* — Browdy and Neimark, PLLC

(57) ABSTRACT

A configurable light fixture for a lighting system is described. The light fixture comprising a receiver, wherein the receiver of the light fixture is arranged to, upon receipt of a pairing signal from a transmitter, store a transmitter ID comprised in the pairing signal in a first memory unit when the pairing signal is received within a pairing time window, the pairing time window being opened when the receiver is switched on from an off state, the receiver being arranged to, upon receipt of a control signal, compare a transmitter ID comprised in the control signal with the stored transmitter ID and release the control signal when the stored transmitter ID corresponds with the transmitter ID comprised in the control signal.

16 Claims, 2 Drawing Sheets

(51) Int. Cl.

| | |
|---|---|
| ***G09G 1/04*** | (2006.01) |
| ***G08C 19/28*** | (2006.01) |
| *G07C 9/00* | (2006.01) |

(56) References Cited

U.S. PATENT DOCUMENTS

| | | | | |
|---|---|---|---|---|
| 5,942,985 | A * | 8/1999 | Chin | 340/5.61 |
| 6,453,687 | B2 * | 9/2002 | Sharood et al. | 62/127 |
| 2002/0047628 | A1 * | 4/2002 | Morgan et al. | 315/291 |
| 2003/0189530 | A1 * | 10/2003 | Tsui | 345/48 |
| 2003/0216139 | A1 * | 11/2003 | Olson et al. | 455/419 |
| 2004/0043802 | A1 * | 3/2004 | Nagano | 455/575.9 |
| 2005/0024228 | A1 * | 2/2005 | Vignon et al. | 340/825.72 |
| 2005/0026602 | A1 * | 2/2005 | Chuey et al. | 455/418 |
| 2006/0049935 | A1 * | 3/2006 | Giannopoulos et al. | 340/533 |
| 2006/0198523 | A1 * | 9/2006 | Shearer | 380/270 |

* cited by examiner

CONFIGURABLE LIGHT FIXTURE, CONFIGURABLE LIGHTING SYSTEM AND METHOD FOR CONFIGURING A LIGHTING SYSTEM

The present invention relates to a configurable lighting system comprising a user interface and a plurality of light fixtures.

Present lighting systems generally comprise a plurality of light fixtures (e.g. comprising one or more LEDs (light emitting diodes) or LED units). Such lighting systems may further comprise one or more user interfaces for controlling the light fixtures. Often, a user interface is intended to control only a subset of the light fixtures. Therefore, the lighting system needs to be configurable such that the appropriate match between the interfaces and the light fixtures is made. Clearly, this can be done by providing an appropriate wiring between the light fixtures and the interface. More advanced lighting systems however may comprise interfaces that control one or more light fixtures in a wireless manner (e.g. using RF or IR transmission) or using PLC (Power Line Communication). In such a system, the user interfaces comprise a transmitter that transmits an RF or IR signal or the like. The light fixtures of the lighting system each comprise a receiver for receiving such a signal. When such a signal is transmitted, it will, in general, be received by all light fixtures of the system, thus including light fixtures that should not respond to the signal. As such, the various light fixtures of a lighting system need to be configured in such manner that they only respond to a control signal originating from a particular user interface or user interfaces. In order to configure such a lighting system, known solutions are to provide a plurality of switches on each light fixture whereby enabling a switch results in the light fixture responding to a predetermined user interface. By setting the switches of the light fixtures of a lighting system one can thus configure the required control of the light fixtures.

The present invention provides an alternative way of pairing a user interface with one or more light fixtures of a lighting system by employing a configurable light fixture which does not require a plurality of switches for configuring.

According to an aspect of the invention, there is provided a configurable light fixture comprising a receiver for receiving a pairing signal transmitted by a user interface, the receiver being arranged to:

- store a transmitter ID comprised in the pairing signal in a first memory unit of the light fixture when the pairing signal is received within a pairing time window, open the pairing time window when the receiver is switched on from an off state, compare, upon receipt of a control signal, a transmitter ID comprised in the control signal with the stored transmitter ID and
- release the control signal when the stored transmitter ID corresponds with the transmitter ID comprised in the control signal.

The configurable light fixture may be applied in a configurable lighting system according to the invention, the lighting system comprising a plurality of configurable light fixtures according to the invention, and a user interface for controlling one or more configurable light fixtures of the plurality of configurable light fixtures, the user interface comprising the transmitter for transmitting the pairing signal to the receivers of the configurable light fixtures. The configurable lighting system according to the invention comprises at least one user interface and a plurality of configurable light fixtures. As an example of such a user interface, a remote control unit or a dimmer knob or the like can be mentioned. Examples of possible light fixtures that can be applied in the configurable lighting system according to the present invention include light bulbs, halogen lights or Light Emitting Diodes (LEDs). The configurable light fixtures as applied in the lighting system according to the invention may further comprise a control unit for controlling the light fixture. Such a control unit can e.g. comprise a programmable device such as a microprocessor or microcontroller or another processing unit, the programmable device being programmed with suitable program instructions in order to provide the functionality as described in this document. Further solutions are imaginable too, such as analogue hardware or electronic circuits.

Each of the one or more user interfaces comprises a transmitter for transmitting a pairing signal, each light fixture comprising a receiver for receiving a signal from a transmitter of one of the interfaces. Where in this document signal or signals is applied, this is to be understood as to comprise any form of data, e.g. as a data stream in any digital format. What is meant with configuring the lighting system in accordance with the present invention is to establish a specific relationship (with respect to responding to control signals) between the one or more user interfaces of the lighting system and the plurality of configurable light fixtures. In general, when one of the user interfaces of the lighting system transmits a control signal, e.g. to modify an illumination parameter of one or more of the lighting fixtures, the signal may be received by all light fixtures of the lighting system whereas only a subset of the fixtures needs to respond to the signal. In order to ensure that the transmission of a control signal is only answered by the appropriate light fixtures, each receiver of a light fixture should know which transmitter to respond to. In general, this is established by providing an identification of the origin of the signal, i.e. the transmitter of the signal with the signal. In the present invention, this is referred to as the transmitter ID. The transmitter ID can e.g. be a 32 bit unique identifier of the transmitter. The transmitter ID need however not be hardware related but may also be a unique code or signal that is transmitted together with a control signal and thus enables a light fixture receiving the signal to identify the origin of the signal (i.e. the transmitter or transmitter's user interface). In order to ensure that only certain light fixtures of the lighting system respond to a particular transmitter, the transmitter ID should be known to the light fixtures such that when a control signal is received by a receiver, the receiver may compare the transmitter ID contained in the control signal with the transmitter ID known to the receiver. In accordance with the invention, the configurable light fixture or configurable lighting system may comprise a comparator for performing the comparison. The comparator can e.g. be incorporated in a control unit of the light fixture. Based on the outcome of this comparison, it can be established whether or not the light fixture needs to release the control signal or not. Releasing the control signal meaning that the receiver has established the correspondence between the stored and received transmitter ID and enables the processing of the information contained in the control signal or provides the control signal to a control unit for processing the information. In accordance with the invention, the configurable light fixture or configurable lighting system may comprise a transfer unit for releasing the control signal. Based upon an output from a comparator comparing a stored transmitter ID and a received transmitter ID, the transfer unit can be arranged to either provide the control signal to a control unit of the light fixture for controlling the light fixture, or to disregard the control signal. The configurable lighting system according to the present invention provides a simple way to provide a transmitter ID to one or more light fixtures of a plurality of light fixtures of a lighting system. In accordance with the present invention, a transmitter of the configurable lighting system is arranged to transmit a pairing signal to the receivers, the signal comprising a transmitter ID, allowing identification of the transmitter. As mentioned, in order to configure the lighting system (i.e. establishing the appropriate configuration of user interface and light fixtures), the transmitter ID needs to be known by the light fixtures. In accordance with the present invention, the receivers of the plurality of light fixtures are configured to store the transmitter ID in a first memory unit when the pairing signal is received within a pairing time window, the pairing time window being opened when the receiver is switched on from an off state. Within the meaning of the present invention, a pairing time window is understood as a period in time during which a receiver is arranged to receive a pairing signal and store the transmitter ID in a first memory unit. So, in order to establish the appropriate relationship between the user interface of the lighting system and the light fixtures, one should ensure that during the transmission of the pairing signal (containing the transmitter ID), the pairing time window of the receivers that need to be paired to the transmitter, is opened or is open. In accordance with the present invention, the pairing time window is opened by switching the receiver from an off state to an on state. As an example, this can be established by momentarily interrupting the power supply to the receiver. As such, the off state of the receiver may correspond to a state wherein the receiver is disabled to receive and process a signal, the on state may thus correspond to a state wherein the receiver is enabled to receive and process signals. Once a receiver is powered again, it is arranged to, during the period of the pairing time window, receive a pairing signal and store the transmitter ID of the pairing signal to a memory unit of the light fixture. In an embodiment, the pairing time window may have a fixed duration, e.g. 2 sec. starting from the moment the receiver is powered.

When a transmitter ID is stored in a memory unit, the receiver of the configurable light fixture can, upon receipt of a control signal, compare a transmitter ID comprised in the control signal with the stored transmitter ID and release the control signal when the stored transmitter ID corresponds with the transmitter ID comprised in the control signal. Releasing the control signal meaning that the receiver has established the correspondence between the stored and received transmitter ID and enables the processing of the information contained in the control signal or provides the control signal to a control unit for processing the information. As such, when a control signal (e.g. to change an illumination parameter of the light fixture) is received and the received transmitter ID matches the stored ID, the control signal can be processed thereby providing the required change in illumination of the light fixture.

During the pairing time window, the receiver is thus susceptible to store a received transmitter ID to a memory unit. Once the pairing time window is closed (e.g. when the fixed period had lapsed), the receipt of a transmitter ID does not result in the transmitter ID being stored. As such, a transmitter ID that is transmitted by a transmitter will only be stored by the receiver when the pairing time window is open during the transmission. By doing so, one can ensure that once a transmitter ID is stored, the receiver only responds to a signal receiver from the transmitter having the corresponding ID. In order to change the stored transmitter ID, the pairing time window would have to be opened again (i.e. the receiver would need to be switched from an off state to an on state again), during which window, a pairing signal would need to be received from a different transmitter.

In case two transmitters would be operated to transmit a pairing signal when the pairing time window of a receiver of a configurable light fixture is open, it may occur that the receiver is paired with the wrong transmitter. What is meant with pairing within the present invention is to establish a one-to-one relationship between a transmitter and a receiver (or a group or receivers). In the present invention, this one-to-one relationship is established by storing an identification of the transmitter (i.e. the transmitter ID) by the receiver (or receivers) to be paired. In an embodiment of the present invention, the pairing time window is closed when the transmitter ID has been stored. By doing so, the risk of pairing with the wrong transmitter can be reduced since, once the pairing time window is closed, the receipt of a pairing signal containing a transmitter ID would not result in the transmitter ID being stored.

In a preferred embodiment of the present invention, the pairing signal as transmitted by the transmitter further comprises a pairing code (this can e.g. be an 8 bit code which is e.g. incremented/changed each time a transmitter sends out a new pairing signal). In this embodiment, the receiver is arranged to store the pairing code in a second memory unit when the pairing code is received outside the pairing time window, and store the transmitter ID only when the pairing code received within the pairing time window corresponds to the pairing code stored in the second memory unit.

In this embodiment, a check is made to ensure that pairing is established with the correct transmitter. This is achieved by transmitting a pairing code with the pairing signal and only storing the transmitter ID when the pairing code received within the pairing time window corresponds to the pairing code stored in the second memory unit. So, in this embodiment, the pairing of a transmitter of a user interface with one or more receivers of light fixtures of the lighting system is only established when the same pairing code is received by the receivers inside and outside the pairing time window.

In case the pairing code is incremented (in general altered) each time a new pairing signal is transmitted, the pairing will only occur if the pairing signal is continuously transmitted from a point in time prior to the opening of the pairing time window (thereby enabling storing the pairing code in the second memory unit) until a point in time within the pairing time window (thereby enabling storing the transmitter ID when the pairing code received within the pairing time window corresponds to the pairing code stored in the second memory unit).

In a preferred embodiment of the present invention, the first and second memory units are non-volatile memory units such that, when the configurable light fixtures are not connected to a power supply, the information stored (i.e. the transmitter ID and/or the pairing code) is not lost.

During normal operation, the user interface (or the user interfaces) of the configurable lighting system is used to sent (via the transmitter) control signals to the light fixtures, e.g. to change/adjust an illumination parameter of the light fixtures. In order to distinguish a 'normal' control signal and a signal intended to pair a transmitter of a user interface with a receiver of a light fixture (i.e. a pairing signal), the transmitter can be arranged to include an identifier (also referred to as signal ID) of the signal enabling the receiver to determine the nature of the signal (i.e. whether it is a control signal or a pairing signal). As such, the pairing signal can comprises a signal ID enabling the receiver to identify the signal received as a pairing signal rather than as a control signal. In order to generate a control signal, several options exist; the user interface may comprise a number of buttons or sliders or rotatable knobs to adjust an illumination parameter. In general, a user interface will also comprise an on/off button. In order to switch a lighting system on or off, this button should only be pushed momentarily. In an embodiment of the configurable lighting system according to the invention, the user interface is arranged to transmit a pairing signal when the on/off button of the user interface is held pushed. As such, no separate button is required that enables the transmission of the pairing signal.

According to a further aspect of the invention, there is provided a method of configuring a light fixture of a lighting system, the method comprising:

- receiving a pairing signal from a transmitter of the lighting system,
- opening a pairing time window of the receiver by switching the receiver from an off state to an on state,
- storing the transmitter ID in a first memory unit of the light fixture when the pairing signal is received within the pairing time window.
- compare, upon receipt of a control signal, a transmitter ID comprised in the control signal with the stored transmitter ID and
- release the control signal when the stored transmitter ID corresponds with the transmitter ID comprised in the control signal.

The method of pairing a user interface with one or more light fixtures can be generalised to a method of pairing a transmitter and a receiver, this method thus comprising the steps of

- transmitting a signal by a transmitter to a receiver, the signal comprising a transmitter ID,
- opening a pairing time window of the receiver by switching the receiver from an off state to an on state,
- storing the transmitter ID in a first memory unit when the pairing signal is received within the pairing time window.

When one of the methods according to the invention is performed using a transmitter and a receiver, both are paired by storage of the transmitter ID in a (preferably non volatile) memory unit. This can e.g. be a memory unit of the receiver or a memory unit of the light fixture in general. In case the light fixture comprise a LED unit (i.e. one or more LEDs) controlled by a control unit of the light fixture, the transmitter ID can be stored in a (preferably non-volatile) memory unit of the control unit as well.

The methods according to the invention may equally be applied to pair a transmitter to a group of receivers such that each receiver that forms part of the group is paired with a single transmitter. As a result, the single transmitter may thus be applied subsequently for controlling the group of receivers simultaneously.

In accordance with the invention, the signals provided by the transmitter of the user interface of the configurable lighting system according to the invention or the signals as received by the receivers of the configurable light fixture or the lighting system according to the invention may e.g. comprise RF signals, IR signals or may be signals provided as PLC (Power Line Communication). In the latter case, signals to the receiver or receivers (e.g. RF signals) are provided via the power lines that power the light fixtures (e.g. a 230V, 50 Hz mains).

DESCRIPTION

Figure 1A:
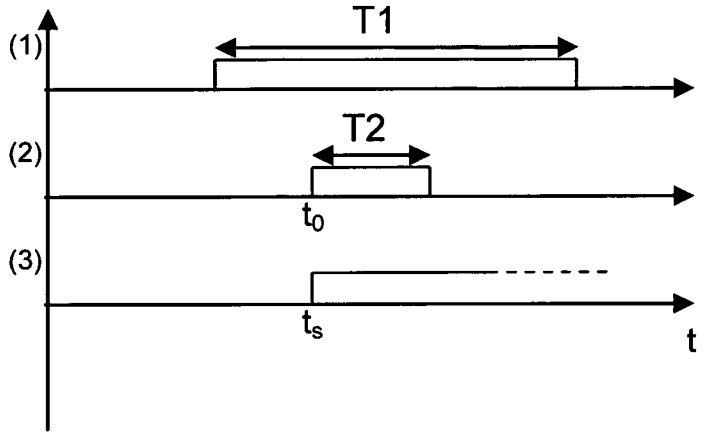
FIGS. 1*a*-1*c* schematically illustrates the relative timing of the different steps of an embodiment of the method according to the invention.
Figure 1B:
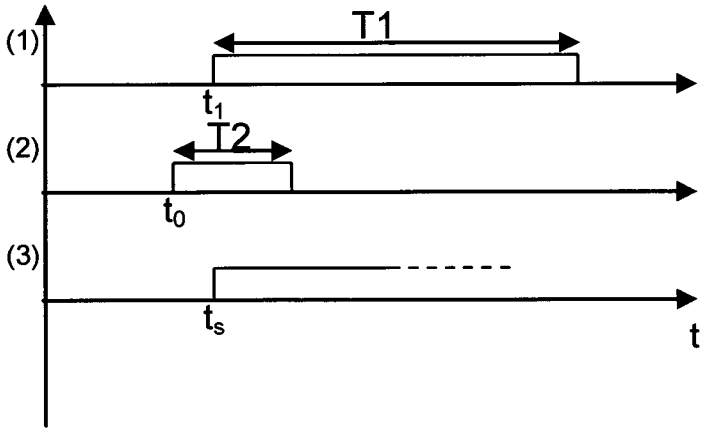
Figure 1C:
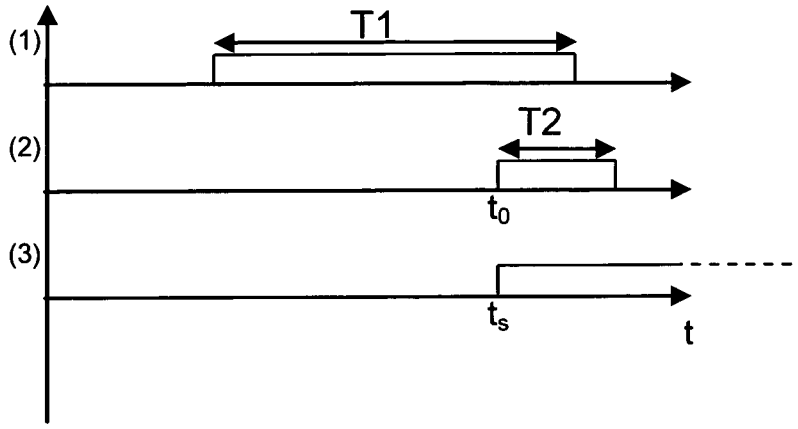

The present invention provides in a configurable lighting system and a configurable light fixture. At present, existing lighting systems comprising light bulbs are being replaced by more advanced light fixtures such as halogen spots or LED fixtures. Such replacement, also referred to as a retrofit operation may enable a more advanced operation of the lighting system. Conventional lighting systems are configured by appropriate wiring of the light bulbs, one or more switches for operating (controlling) the light bulbs and a power source (e.g. a mains 230 V). In an embodiment of the present invention, the configuration of the lighting system is established as follows:

In order to pair a transmitter of a user interface of the configurable lighting system according to the present invention with a receiver of a light fixture according to the present invention, the transmitter may transmit a pairing signal during a certain period T1. This is illustrated by curve (1) of FIG. 1*a*. The pairing signal comprises a transmitter ID (e.g. a 32 bit identification of the transmitter). Curve (2) of FIG. 1*a* schematically depicts a period T2 (also referred to as the pairing time window) during which the receiver of the transmitted pairing signal is arranged to, upon receipt of such a signal, store the transmitter ID that is contained in the signal, in a non-volatile memory unit. This can e.g. be a memory unit of the receiver itself. Curve (3) of FIG. 1*a* schematically depict the point in time ts from which point forward, the transmitter ID is stored in the non-volatile memory unit. In FIG. 1*a*, the point in time ts substantially corresponds with t0, the starting point of the pairing time window T2, because the pairing signal is already being transmitted at that starting point. FIGS. 1*b* and 1*c* schematically illustrate the same curves but with a different relative position of the periods T1 and T2. In FIG. 1*b*, the transmission of the pairing signal (curve (1)) only commences when the pairing time window (curve (2)) is already open. Therefore, the storage of the transmitter ID only occurs at a point in time substantially corresponding to the point in time t1 when the transmission commences. In FIG. 1*c*, the transmission of the pairing signal (curve (1)) ends before the pairing time window (curve (2)) is closed, this however does not affect the transmitter ID being stored; as in FIG. 1*a*, curve (3) schematically depict the point in time is from which point forward, the transmitter ID is stored in the memory unit.

Figure 2:
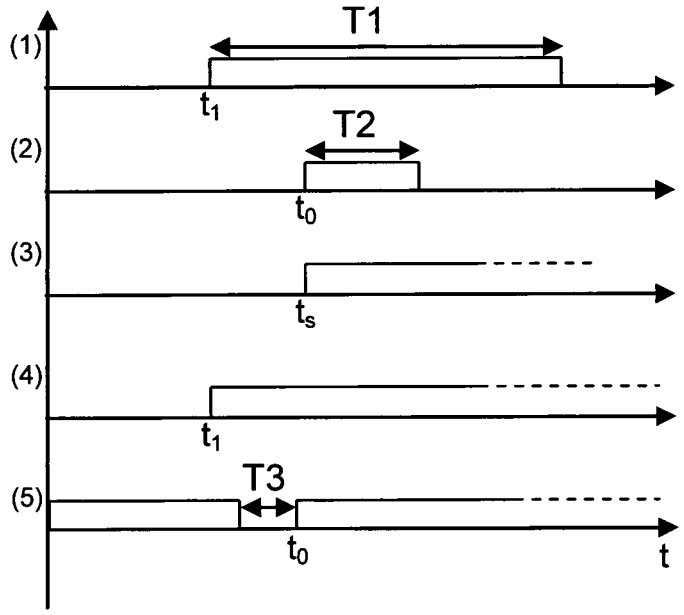
FIG. 2 schematically depicts a second way of pairing a configurable light fixture or a configurable lighting system according to the present invention.

FIG. 2 schematically depicts a second way of pairing a configurable light fixture or a configurable lighting system according to the present invention. FIG. 2 schematically illustrates the pairing process when the pairing signal includes a pairing code.

Curves (1), (2) and (3) correspond to the curves as indicated in FIGS. 1*a*-1*c*: Curve (1) indicates the period T1 when the pairing signal is transmitted, curve (2) indicates the pairing time window T2 and curve (3) indicates the storage of the transmitter ID. Curve (4) indicates when the pairing code that is comprised in the pairing signal is stored in a memory unit, this is done starting from t1, the point in time t1 when the transmission of the pairing signal commences. Curve (5) schematically indicates when the receiver is powered. As can be seen, in order to start the pairing time window T2, the receiver is temporarily turned off (during a period T3) such that, when it is switched back on, the pairing time window T2 starts. In accordance with the embodiment as illustrated, the transmitter ID is only stored when the pairing code received within the pairing time window corresponds to the pairing code stored in the memory unit.

By doing so, the risk of pairing a receiver with the wrong transmitter can, to a large extent, be removed.

The pairing code as applied in the embodiment as illustrated can e.g. be an 8 bit code which is changed each time a new pairing signal is transmitted. In this case, the transmission of the pairing signal may not be interrupted during the period starting when the pairing code received outside the pairing time window is stored and ending when the pairing code and transmitter ID are received inside the pairing time window. An interruption of the pairing signal would result in a mismatch between the stored pairing code and the pairing code received during the pairing time window.

An application of the present invention can be illustrated as follows, given a lighting system comprising a plurality of user interfaces and a plurality of light fixtures, each user interface comprising a transmitter for transmitting a signal, each light fixture comprising a receiver for receiving a signal from a transmitter of the plurality of transmitters and wherein the receivers are configured to operate according to the pairing method according to the invention. The plurality of light fixtures of the lighting system may thus be controlled by the plurality of user interfaces in a configuration that is established using the pairing method according to the invention. As an example, the lighting system may comprise two user interfaces UI1 and UI2 and four light fixtures L1, L2, L3 and L4. Using any of the pairing methods according to the invention, a receiver of the light fixture L1 can be paired with a transmitter of the user interface UI1 whereas the user interface UI2 can be paired with the light fixtures L2, L3 and L4. As such, the transmitter ID of the transmitter of UI1 will be stored in the receiver of light fixture L1 whereas the transmitter ID of the transmitter of UI2 will be stored in the receiver of light fixtures L2, L3 and L4. When subsequently, a signal is transmitted by UI1 to adjust an illumination parameter, the signal may e.g. be received by all four light fixtures of the lighting system. When the transmitted signal comprises the transmitter ID, the receivers of the lighting system can be configured to compare the received ID with the stored ID and only respond to the transmitted signal when the received ID matched with the stored ID.

By applying the pairing method as mentioned, pairing between a transmitter and a receiver can be established by switching off/on the receiver and comparing a received signal before and after the switching. By doing so, there is no need to provide a number of switches on the receiver to select the receiver to only respond to a certain transmitter.

By applying the method according to the present invention to pair the transmitter and receiver, the transmitter ID is stored in a memory unit, e.g. of the receiver. As such, when the transmitter subsequently transmits a signal, the receiver can compare the transmitter ID of the signal to the stored ID and can establish whether or not to release the signal.

In order to change an illumination parameter of a light fixture or a group of light fixtures, a signal can be transmitted by a transmitter of a user interface of the lighting system. Such a signal can e.g. comprise a new set point for the illumination parameter (e.g. brightness or colour). In addition, such a signal may comprise a transmitter ID which, upon receipt, is compared by the receiver with a stored transmitter ID. In order to distinguish between a signal for pairing a transmitter to a receiver and a signal for changing an illumination parameter, the signal as transmitted may contain a code (a signal ID, e.g. a 4-bit identification tag) indicating the purpose of the signal and recognised by the receiver as such.

As such, when a signal is transmitted by a transmitter of a user interface of the lighting system, the signal will, in general, be received by all receivers. Based on the code contained in the signal, the receiver may recognise the signal as an instruction to change an illumination parameter of the light fixture associated with the receiver. When the transmitter ID contained in the signal matches the ID stored in a memory unit of the receiver, a control unit of the light fixture can adjust the illumination parameter of the light fixture in accordance with the signal.

A configurable light fixture according to the present invention or as applied in a lighting system according to the present invention may comprise:

- a receiver for receiving signals from a transmitter of a user interface
- a LED unit comprising one or more LEDs (light emitting diodes)
- a controller for controlling the LED unit using a signal received by the receiver.

It will be clear to the skilled person that the functionality of the receiver and the controller may be combined in a single unit.

In the embodiment of the invention as illustrated in FIG. 2, the receivers of the light fixtures are actually configured to operate in two different modes or states when a pairing signal is transmitted and received by the receiver. In a first mode, the transmission of a pairing signal to the receiver results in the pairing code contained in the pairing signal being stored by the receiver. In a second mode, the transmission of a pairing signal to the receiver results in the received pairing code being compared to a pairing code stored. If both codes match, the transmitter is paired with the receiver (i.e. the transmitter ID is stored by the receiver).

The present invention may also be applied to configure a single user interface such that it can control more than one group of light fixtures, each group e.g. comprising one or more configurable light fixtures according to the invention. This can be arranged by including a group ID (e.g. a 4 or 8 bit identification code) with the transmitter ID of the user interface. The user interface can e.g. be enabled to transmit different pairing signals (i.e. comprising the same transmitter ID but a different group ID), e.g. by a selector or switch on the user interface. The configurable light fixtures may further be arranged to both store the transmitter ID and the group ID in the first memory unit and only release a control signal comprising a transmitter ID and a group ID when both IDs match with the stored IDs.

The present invention may advantageously be applied to retrofit existing lighting systems or applications. Retrofitting an existing lighting system may e.g. involve replacing existing light bulbs of the lighting system by configurable light fixtures according to the invention. The configurable light fixtures may then e.g. be configured to respond to a user interface (e.g. a remote control unit) comprising a transmitter using the methods as described above. Retrofitting the exiting lighting system may equally involve replacing the existing user interface (e.g. a simple switch or dimmer provided on a wall) by a user interface comprising a transmitter for providing pairing and control signals to the configurable light fixtures. As mentioned above, pairing the required receivers (of the configurable light fixtures) with the transmitter can be established by momentarily interrupting the power to the receivers and ensuring that a pairing signal is provided when the receivers are switched from an off state to an on state. In an embodiment, the transmitter of the user interface of the configurable lighting system according to the invention (e.g. a retrofitted lighting system as described) is provided with a battery or capacitance such that an interruption of the power supply to the transmitter does not disable the transmitter to transmit a pairing signal to the receiver or receivers to be paired. In such an arrangement, the pairing of the transmitter and the receiver or receivers may be realised by interrupting the power supply of both the transmitter and receiver or receivers. In such an arrangement, the transmitter may also be arranged to control the switching from an on to off state of the light fixtures. The present invention may thus be advantageously be applied for retrofitting purposes in e.g. the following situation: Assuming illumination being provided in two rooms, each room being provided with one or more light bulbs and a lighting switch controlling the power to the light bulbs. When the light bulbs are replaced by configurable light fixtures according to the invention and a user interface (or user interfaces) is provided for providing control signals to the light fixtures, the lighting system comprising the light fixtures and the user interface (or interfaces) can be configured according to the invention such that the light fixtures in the two rooms can be separately controlled. Advantageously, the configuration can be established by opening the pairing time window by momentarily interrupting the power supply to the receivers, which can be done by operating the lighting switch of one of the two rooms thereby pairing a user interface with the light fixtures in that room. In a similar manner, the other one of the two rooms can be paired with another user interface or with the same user interface in case this user interface can e.g. operate in different modes thereby transmitting different transmitter IDs. The user interface (or interfaces) can e.g. be a remote device or an interface (or interfaces) mounted to a wall of the rooms. The interface can e.g. enable the brightness and or colour of the light fixtures in the rooms to be altered thereby increasing the functionality of the lighting available.

It can further be mentioned that the embodiments of the configurable light fixture or the configurable lighting system are intended to illustrate the invention, the invention not being limited to the embodiments as shown. The present invention can be applied in a variety of light fixtures, thus not limited to halogen spots or LED fixtures. Also, the user interface as applied in a configurable lighting system according to the invention should not be limited to conventional user interfaces as applied in lighting systems such as switches or dimmers mounted to a wall or remote control units.

The invention claimed is:

1. A configurable light fixture comprising a receiver for receiving a pairing signal transmitted by a transmitter of a user interface, the pairing signal comprising a receiver independent transmitter ID enabling an identification of the transmitter, the receiver being arranged to:

receive a pairing signal transmitted by the transmitter, the pairing signal comprising the receiver independent transmitter ID, the pairing signal being transmitted by the transmitter during a period T1, store the received receiver independent transmitter ID comprised in the pairing signal in a first memory unit of the light fixture only when the pairing signal is received within a pairing time window, the pairing time window having a period T2, the period T2 at least partly overlapping the period T1, open the pairing time window having the period T2 when the receiver is switched on from an off state, compare, upon receipt of a control signal from a transmitter, a transmitter ID comprised in the control signal with the stored transmitter ID, and release the control signal when the stored receiver independent transmitter ID corresponds with the transmitter ID comprised in the control signal.

2. The configurable light fixture according to claim 1 wherein the pairing time window has a fixed length.

3. The configurable light fixture according to claim 1 wherein the pairing time window is closed when the transmitter ID has been stored.

4. The configurable light fixture according to claim 1 wherein the receiver is further arranged to store a pairing code of the pairing signal in a second memory unit when the pairing code is received outside the pairing time window, the receiver further being arranged to store the transmitter ID only when the pairing code received within the pairing time window corresponds to the pairing code stored in the second memory unit.

5. The configurable light fixture according to claim 1 wherein the pairing signal further comprises a group ID, the receiver being arranged to store the group ID together with the transmitter ID.

6. The configurable light fixture according to claim 1 wherein the second memory unit comprises a non-volatile memory unit for storing the pairing code.

7. The configurable light fixture according to claim 1 wherein the first memory unit comprises a non-volatile memory unit for storing the transmitter ID.

8. The configurable light fixture according to claim 1 wherein the pairing time window is opened by momentarily interrupting a power supply to the receiver.

9. A configurable lighting system comprising a plurality of configurable light fixtures according to claim 1, and a user interface for controlling one or more configurable light fixtures of the plurality of configurable light fixtures, the user interface comprising the transmitter for transmitting the pairing signal to the receivers of the configurable light fixtures.

10. The configurable lighting system according to claim 9 wherein the pairing signal is transmitted when an on/off button of the user interface is held pushed.

11. The configurable lighting system according to claim 9 wherein the pairing signal comprises an RF signal.

12. The configurable lighting system according to claim 9 wherein the pairing signal comprises an IR signal.

13. The configurable lighting system according to claim 9 wherein the pairing signal is provided by Power Line Communication.

14. The configurable lighting system according to claim 9 wherein the pairing signal comprises a signal ID enabling the receiver to identify the pairing signal.

15. The configurable lighting system according to claim 9 wherein the user interface is provided with a battery or capacitance for powering the transmitter.

16. A method of configuring a light fixture of a lighting system, the method comprising:

receiving, at a receiver in the lighting system, a pairing signal from a transmitter of the lighting system, the pairing signal comprising a receiver independent transmitter ID enabling an identification of the transmitter, the pairing signal being transmitted by the transmitter during a period T1, opening a pairing time window of the receiver by switching the receiver from an off state to an on state, the pairing window having a period T2, the period T2 at least partly overlapping the period T1, storing the transmitter ID in a first memory unit of the light fixture when the pairing signal is received within the pairing time window, compare, upon receipt of a control signal from a transmitter, a transmitter ID comprised in the control signal with the stored transmitter ID, and release the control signal when the stored transmitter ID corresponds with the transmitter ID comprised in the control signal.

* * * * *